US005701541A

United States Patent [19]

Ueda et al.

[11] Patent Number: 5,701,541

[45] Date of Patent: Dec. 23, 1997

[54] AUTOMATIC PROCESSING MACHINE FOR SILVER HALIDE PHOTOGRAPHIC LIGHT-SENSITIVE MATERIALS

[75] Inventors: Yutaka Ueda; Ken Okauchi; Shigeharu Koboshi, all of Hino, Japan

[73] Assignee: Konica Corporation, Tokyo, Japan

[21] Appl. No.: 681,868

[22] Filed: Jul. 29, 1996

[30] Foreign Application Priority Data

Aug. 11, 1995 [JP] Japan ..... 7-205756

[51] Int. Cl.[6] ..... G03D 13/00

[52] U.S. Cl. ..... 396/569; 396/570; 396/639

[58] Field of Search ..... 396/569, 570, 396/578, 624, 626, 627; 134/64 P, 64 R, 122 P; 118/691; 430/434, 438, 398–400

[56] References Cited

U.S. PATENT DOCUMENTS

| | | | |
|---|---|---|---|
| 3,610,131 | 10/1971 | Frick et al. | 134/64 P |
| 4,314,753 | 2/1982 | Kaufmann | 396/569 |
| 4,327,987 | 5/1982 | Friar et al. | 396/627 |
| 4,527,878 | 7/1985 | Taniguchi et al. | 396/569 |
| 4,537,496 | 8/1985 | Ohba et al. | 118/691 |
| 4,736,221 | 4/1988 | Shidara | 396/609 |
| 4,881,095 | 11/1989 | Shidara | 346/569 |
| 5,114,836 | 5/1992 | Sato et al. | 430/434 |
| 5,319,408 | 6/1994 | Shiota | 396/669 |
| 5,506,652 | 4/1996 | Gogle et al. | 396/569 |
| 5,557,362 | 9/1996 | Ueda | 396/626 |

*Primary Examiner*—D. Rutledge

*Attorney, Agent, or Firm*—Frishauf, Holtz, Goodman, Langer & Chick, P.C.

[57] ABSTRACT

An apparatus for processing a silver halide photographic material having an emulsion surface, includes a supply device to supply processing solution from a container to the emulsion surface through a space; a converter to convert one of density level of an image signal and a light amount of a exposure signal into a processing signal representing an amount of the processing solution; a regulating device to regulate an amount of the processing solution in accordance with the processing signal so that the regulated amount of the processing solution is supplied to the emulsion surface of the silver halide photographic material through the space by the supply device.

21 Claims, 8 Drawing Sheets

AUTOMATIC PROCESSING MACHINE FOR SILVER HALIDE PHOTOGRAPHIC LIGHT-SENSITIVE MATERIALS

BACKGROUND OF THE INVENTION

The present invention relates to an automatic processing apparatus (hereinafter referred to simply as an automatic processing machine) for silver halide photographic light-sensitive materials wherein a silver halide photographic light-sensitive material is processed by processing solutions.

Due to recent proliferation of many minilab shops, the amount of light-sensitive materials processed by one unit of a minilab has been reduced, and the replacement rate of processing solution in their processing tanks per day has been lowered accordingly. Therefore, the processing solution is deteriorated, and stable processing power tends to be unsatisfactory. In the case of color developing solutions, in particular, processing solutions deteriorate markedly by air oxidization, and it is extremely difficult to maintain stable processing power.

Japanese Patent Publication Open to Public Inspection No. 324455/1994 (hereinafter referred to as Japanese Patent O.P.I. Publication) discloses a technology wherein a processing solution for processing a silver halide photographic light-sensitive material is supplied to the emulsion surface of a silver halide photographic light-sensitive material through a gas phase from a processing solution container in which the processing solution is contained hermetically.

By supplying a processing solution for processing a silver halide photographic light-sensitive material to the emulsion surface of a silver halide photographic light-sensitive material through a a gas phase from a processing solution container in which the processing solution is contained hermetically as in Japanese Patent O.P.I. Publication No. 324455/1994, it is possible for sure to improve keeping quality of a processing solution (in the case of a color developing solution, in particular), compared with a conventional method.

However, in the above-mentioned patent, neither a means nor a technology for reducing an amount of a processing solution to be supplied to the light-sensitive emulsion surface is described at all. This means that a processing solution supplied to the surface of an emulsion layer of a light-sensitive material is carried over to the following tank (for example, a bleach-fixing tank), though the amount of processing solution used due to the above-mentioned technology is small compared to a conventional type (a processing solution dipping type). It is natural that, as the amount of processing solution fed is larger, reduction of performance in the following tanks due to aforesaid carrying over is caused.

In addition, when the liquid surface of the processing solution inside the housing container is reduced, oxidation of the processing solution is caused under the running processing wherein the amount of processing solution is extremely small, even though the processing solution is tightly closed in the housing container. Specifically, if the processing solution is that for color developing, oxidized product of the color developing agent is produced inside the processing solution. It turned out that, due to the adherence of the above-mentioned oxidized product of the color developing agent on a white background portion, stain occurs.

SUMMARY OF THE INVENTION

An object of the present invention is to provide an automatic processing machine maintaining stable processing performance even when the amount of processing is extremely small and capable of reducing to minimum the consumption of processing agent component used for aforesaid automatic processing machine.

The present inventor studied laboriously for attaining the above-mentioned object. As a result, it turned out that the above-mentioned problem can be overcome by the following constitutions. Namely, the above-mentioned problems can be overcome by an automatic processing machine for silver halide photographic light-sensitive material having a processing solution container which houses a processing solution processing a silver halide photographic light-sensitive material, a means for feeding the processing solution processing a silver halide photographic light-sensitive material onto an emulsion surface of the silver halide photographic light-sensitive material through a a gas phase, an operation means which converts an image signal which is recorded onto aforesaid silver halide photographic light-sensitive material into an amount of processing solution fed onto the emulsion surface of the silver halide photographic light-sensitive material and an adjusting means which adjusts the amount of processing solution fed onto the emulsion surface of the silver halide photographic light-sensitive material.

By adjusting the amount of feeding the processing solution in accordance with an image signal recorded on a light-sensitive material, the above-mentioned automatic processing machine for silver halide photographic light-sensitive material of the present invention can stop feeding of the processing solution on a white portion of the image. Due to this, the amount of processing solution used and the amount of processing agent can further be reduced, and concurrently with this, it is not necessary to feed the processing solution on the white portion. Accordingly, it is possible to completely prevent the occurrence of stains due to the oxidized product of a color developing agent.

The image signal referred in the present invention may either be optical measurement density (integral density) read by a conventional image reading apparatus or an inputted signal such as a digital image signal housed in a photo CD. In addition, an outputted signal such as an amount of exposure to a light-sensitive material which has already been operated may be included. When the image signal of the present invention is the above-mentioned inputted signal, it is possible to convert this inputted signal directly to the amount of feeding of the processing solution.

In the present invention, as a processing solution feeding means which feeds the processing solution onto the emulsion surface of the light-sensitive material through a gas phase and a processing solution splashing means which splashes the processing solution onto the light-sensitive material through a gas phase and a processing solution coating means which coats the processing solution onto the light-sensitive material through a gas phase, for example, a curtain coater, are cited. As the processing solution splashing means which splashes the processing solution onto the light-sensitive material through a gas phase, one which has the same structure a the ink jet head section of an ink jet printer, one which generates pressure in a splashing means after processing the processing solution onto the light-sensitive material through a gas phase, and then, which actively splashes as described in Japanese Patent O.P.I. Publication No. 324455/1994 and one which splashes the processing solution due to solution pressure applied to the splashing means after processing the processing solution onto the light-sensitive material through a gas phase as in a spray bar are cited. As the processing solution splashing means which splashes the processing solution onto the emulsion surface of the light-sensitive material through a gas phase due to an identical structure as the ink jet head portion of the ink jet printer, one which feeds the processing solution due to vibration and one which feeds the processing solution due to sudden boiling are cited. These technologies are so preferable that they can control the amount of processing solution feeding amount and the position for processing the light-sensitive material.

As a processing solution feeding means, any method may be used including a method wherein the processing solution is fed onto the light-sensitive material through a gas phase from a bar-shaped feeding head, a method wherein the processing solution is fed onto the light-sensitive material through a gas phase from a surface-shaped feeding head and also a method wherein the processing solution is fed onto the light-sensitive material through a gas phase from a dot-shaped feeding head. In addition, when the light-sensitive material is a sheet type, the processing solution may be fed onto the light-sensitive material from the feeding head by the use of the surface-shaped feeding head corresponding to the size of the light-sensitive material under a condition in which the position relationship between the light-sensitive material and the feeding head is fixed. However, a method to feed the processing solution onto the light-sensitive material through a gas phase from the feeding head while shifting the position relationship between the light-sensitive material and the feeding head is preferable because sufficient processing solution can be fed onto the light-sensitive material even if the feeding head is small. In addition, when the bar-shaped feeding head is used, the feeding head may be shifted. However, in order to feed rapidly the processing solution onto the light-sensitive material, it is preferable to shift the light-sensitive material in other than the parallel direction with the bar-shaped feeding head. Specifically, in order to keep processing time constantly, it is preferable to shift the light-sensitive material in perpendicular direction with the bar-shaped feeding head. In addition, as the processing solution splashing means, when the processing solution is splashed onto the light-sensitive material through a gas phase from the feeding head while shifting the position relationship between the light-sensitive material and the feeding head, the number of splashing the processing solution onto the light-sensitive material per one second by the processing solution splashing means is preferably once or more, and specifically preferably 10 times or more. In addition, since the processing solution is splashed from the feeding head, it is preferable to be $1\times10^{6}$ times or less and more preferable to be $1\times10^{5}$ times or less.

In addition, when the processing solution feeding means feeds the processing solution through a feeding port, the shape of the feeding port may be anything including circular, square or ellipse. The area of the feeding port is preferably $1\times10^{-11}$ $m^2$ or more and specifically preferably $1\times10^{-8}$ $m^2$ or more in order to prevent clogging due to slight drying of the processing solution. In addition, in order to uniformly feed the processing solution onto the light-sensitive material, the area of each feeding port is preferably $1\times10^{-8}$ $m^2$ or less and specifically $1\times10^{-6}$ $m^2$ or less. In addition, the interval of each feeding port in terms of the average of two adjacent end of feeding port is preferably $5\times10^{-6}$ $m^2$ and specifically preferably $1\times10^{-3}$ $m^2$ in order to sufficiently feed the processing solution onto the surface of the light-sensitive material.

The distance between the processing solution feeding port and the emulsion surface of the light-sensitive material is preferably 50 μm or more (specifically 1 mm or more) in order to easily control this distance, and more preferably 10 mm or less (the most preferably 5 mm or less).

[Heating means]

The temperature of the light-sensitive material heated by a heating means may be 35° C. or less. However, it is preferable to be 35° C. or more, specifically preferably 40° C. or more and the most preferably 45° C. or more. In addition, considering heat-durability of the light-sensitive material and control ease of processing, 100° C. or less is preferable and 90° C. or less is more preferable.

As a heating means for heating the light-sensitive material, a transfer heating means which heat due to contacting and transferring heat of the light-sensitive material with a heating drum or a heating belt and a irradiation heating means which heat the light-sensitive material by irradiating an infrared beam and high frequency electromagnetic wave are cited.

In addition, it is preferable to have a heating control means which controls in such a manner that the above-mentioned heating means heats the light-sensitive material when the light-sensitive material exists on a position of the heating means because unnecessary heating can be prevented. This can be attained by a structure having a conveyance means which conveys the light-sensitive material at a prescribed conveyance speed and a light-sensitive material sensing means which senses the existence of the above-mentioned light-sensitive material at a prescribed position on the upperstream side of the conveyance direction in the above-mentioned conveyance means compared to the position where the heating means heats the light-sensitive material, wherein the above-mentioned heating control means controls in accordance with sensing by the above-mentioned light-sensitive material sensing means. In this occasion, it is preferable that controlling is conducted in such a manner that the above-mentioned heating means conducts a prescribed heating since a prescribed time passed after the above-mentioned light-sensitive material sensed the existence of the silver halide photographic light-sensitive material from non-existence until a prescribed time passed after the above-mentioned light-sensitive material sensed the non-existence of the silver halide photographic light-sensitive material from existence.

In the present invention, when an image signal is an inputting signal such as the above-mentioned light measured density (integral density), the apparatus may have a means for converting the above-mentioned integral density to each of independent yellow, magenta and cyan (analysis density) (see Japanese Patent O.P.I. Publication No. 88344/1992). In addition, it may have a means for converting the above-mentioned Y, M and C analysis density to the amount of exposing the light-sensitive material to B, G and R light. As a method of converting from this analysis density to the amount of exposure to light, the analysis density may be converted in accordance with characteristics curves between the amount of exposure to each of R, G and B light and the analysis density (Y, M and C coloring density) of the panchromatic layer, the ortho layer and the regular layer, or may be converted from the relationship of the measurement density, provided that the analysis density is defined to be a measurement density in which the processed light-sensitive material was measured by a densitometer.

In the present invention, as a method for providing exposure to the light-sensitive material, a type using the CRT and a type using an LED array may be used.

As an operation method which converts the coloring density Dy, Dm, Dc of the present invention to a necessary color developing agent amount, a method to provide exposure which causes plural density steps for each of yellow, magenta and cyan which color respectively in a blue-sensitive layer, a green-sensitive layer and a red-sensitive layer to the light-sensitive material (wedge exposure), to measure the amount of coloring dye or the amount of developing metal per Y, M and C unit area produced in each density step and to prepare operational functions f(Dy), g(Dm), h(Dc) using a relationship between the above-mentioned amount of Y, M and C coloring dye or the amount of developing silver produced and the coloring density Dy, Dm, Dc.

A conventional method is applicable to a preparation method of an operational function. For example, it is described in a thesis for a degree to the University of Tokyo "Color-Measuring analysis of Color Reproduction in a Subtractive Method Color Photography", Volume 2nd, Chapter 1, "Retrograde reflective density".

When a light-sensitive material to be processed is a light-sensitive material for transmission use, provided that independent coloring density of the above-mentioned Y. M and C colorants are Dy, Dm and Dc and the amount of dye generation corresponding to each coloring density is My, Mm and Mc, the following equations are formed.

$$My=\frac{10Dy}{\epsilon y} \quad (a)$$

$$Mn=\frac{10Dm}{\epsilon m}$$

$$Mc=\frac{10Dc}{\epsilon c}$$

wherein $\epsilon y$, $\epsilon m$ and $\epsilon c$ independently represent mol light absorption coefficient of Y, M and C dye.

On the other hand, when the light-sensitive material to be processes is a photographic paper, (in the case that the above-mentioned coloring density Dy, Dm and Dc>1.3)

$$My=\frac{10}{\epsilon y}\ (Dy-0.3994)/2.148 \quad (b)$$

$$Mm=\frac{10}{\epsilon m}\ (Dm-0.3994)/2.148$$

$$Mc=\frac{10}{\epsilon c}\ (Dc-0.3994)/2.148$$

(in the case that the above-mentioned coloring density Dy, Dm and Dc<1.3)

$$My = \frac{10}{\epsilon y}\ (-0.0031+0.1036\times Dy+0.40255\times Dy^2-1.305\times Dy^3+2.6971\times Dy^4-2.29\times Dy^5+0.679488\times Dy^6) \quad (c)$$

$$Mm = \frac{10}{\epsilon m}\ (-0.0031+0.1036\times Dm+0.40255\times Dm^2-1.305\times Dm^3+2.6971\times Dm^4-2.29\times Dm^5+0.679488\times Dm^6)$$

$$Mc = \frac{10}{\epsilon c}\ (-0.0031+0.1036\times Dc+0.40255\times Dc^2-1.305\times Dc^3+2.6971\times Dc^4-2.29\times Dc^5+0.679488\times Dc^6)$$

Necessary amount of color developing agent V (mol) is:

$$V=aMy+bMm+cMc=f(Dy)+g(Dm)+h(Dc) \quad (d)$$

When the processed light-sensitive material is a photographic paper, it has a layer structure of the red-sensitive layer, the green-sensitive layer and the blue-sensitive layer from the top. Accordingly, a yellow coloring reactivity of the lowermost blue-sensitive layer is inferior to a magenta and cyan coloring reactivity in the upper layers. Accordingly, the relationship of the above-mentioned conversion functions f, g and h for the same coloring density D1 become $$f(D1)\geqq g(D1) \text{ concurrently with } f(D1)\geqq h(D1).$$

Therefore, in order to obtain identical coloring density between Y, M and C, it is preferable to provide the amount of color developing agent provided when coloring Y greatestly.

In the present invention, as a means for adjusting the amount of providing color developing agent, the following methods can be used:

(1) To adjust the amount of providing due to adjusting the number of sprayed dot per unit area in the same manner as in a conventional ink-jet method, (2) To adjust the amount of feeding by adjusting the spraying number (frequency) of the processing solution per unit time.

(3) To adjust the amount of feeding by adjusting the amount of spraying the processing solution per unit. (for example, in the case of feeding the processing solution by means of a bubble-jet system, amount of unit feeding is adjusted by adjusting time for heating the heater to the processing solution sudden boiling temperature.)

In the present invention, a processing step to feed the processing solution onto the emulsion surface of the light-sensitive material through a gas phase is preferably located in the color developing step and/or bleaching step wherein the amount of reacted and resulting product changes depending upon the amount of exposure, and more preferably located in the color developing step wherein stable processing performance, especially stable processing agent storage property is desired.

A processing agent for color developing used in the present invention may be liquid or solid. However, from viewpoint of stability of the processing agent and handling property, a solid processing agent is preferable.

[Solid processing agent supplying means]

As a solid processing agent supplying means which supplies a solid processing agent to a processing solution container, when the solid processing agent is a tablet, any means may be used, provided a tablet is supplied to the processing solution container, including conventional methods described in Japanese Utility Publication Open to Public Inspection (hereinafter, referred to as Japanese Utility O.P.I. Publication) Nos. 137783/1988, 97522/1988 and 85732/1989. When the solid processing agent is granule or powder, a gravity dropping type means as described in Japanese Utility O.P.I. Nos. 81964/1987 and 84151/1988 and Japanese Patent O.P.I. Publication No. 292375/1989 and a screw type or a tap type means described in Japanese Utility O.P.I. Publication Nos. 105159/1988 and 195345/1988 may be used. However, it is not limited thereto.

An amount of solid processing agent at one time is preferably 0.1 g or more from viewpoint of durability of the solid processing agent supplying means and accuracy of supplying amount at one time, and also preferably 50 g or less from viewpoint of dissolution time.

[Replenisher water]

Replenisher water is a solution providing an effect to dissolve the solid processing agent supplied to the processing solution container. Ordinarily, it is water.

[Solid processing agent]

The solid processing agent is a solid processing agent containing processing agent components of a processing solution which processes the light-sensitive material, including powder, tablet, pill and granule. In addition, as necessary, those provided with a water-soluble lamination on a surface thereof such as a water-soluble polymer. Powder in the present invention is an aggregate of fine particle crystal. Granule in the present invention is granulated product of powder, preferably particles having 50–5000 μm particle size. Tablet in the present invention is a powder or granule compressed and molded to a certain form. Pill or granule are molded to round (including a potato shape and a spherical shape) due to granulating or tableting. Of the above-mentioned solid processing agent, either of granule, tablet or pill is preferable, because dust few occurs during handling and supplying accuracy is high. Of them, tablet is preferably used because replenishing accuracy is high, handling property is simple and it dissolves rapidly without changing density so that the effects of the present invention is favorably provided.

In order to solidify a photographic processing agent, arbitrary means can be adopted, for example, a method wherein a photographic processing agent (a condensed solution, fine powder or granule type) and a water-soluble binder are kneaded for molding or a method wherein a laminated layer is formed by spraying a water-soluble binder on the surface of a temporarily-molded photographic agent (see Japanese Patent O.P.I. Publication Nos. 29136/1992 and 85533/1992 through 85536/1992 and 172341/1992).

A preferable production method of a tablet is to form a tablet by tableting granules after granulating powder solid processing agent. The above-mentioned production method has merits that dissolubility and storage stability thereof are improved compared to a solid processing agent prepared by a method wherein a solid processing component is simply mixed and a tablet is formed by a tableting process and thereby photographic performance is also stable. As a granulating method for preparing a tablet, a granule or a pill, conventional methods including a transmission granulation method, an extrusion granulation method, a compression granulation method, a crushing granulation method, a stirring granulation method, a fluid bed layer granulation method and a spray and drying granulation method can be used. In addition, when granulating, it is preferable to add a water-soluble binder by 0.01–20 wt %. As a water-soluble binder, celluloses, dextrins, saccharide alcohols, polyethylene glycols and cyclodextrin are preferable.

Hereinafter, examples of preferable compounds are described. However, the present invention is not limited thereto.

I. Water-soluble polymers

Polyethylene glycol, polyvinyl alcohol, pollvinyl pyrroridone, pollvinyl acetal, polyvinyl acetate, aminoalkyl methacrylate copolymer, methacrylic acid-methacrylic acid ester copolymer, methacrylic acid—acrylic acid ester copolymer and methacrylic acid-containing betaine type polymer.

II. Saccharides

Monosaccharides such as glycose and galactose, disaccarides such as maltose, saclose and lactose, alcohol saccharides such as mannitol, solbitol and erisrytol, pululane, methylcellulose, ethylcellulose, hydroxypropyl cellulose, hydroxypropyl methylcellulose, acetic acid phthalic acid cellulose, hydroxypropyl methylcellulose phthalate, hydroxypropyl methylcellulose acetate succinate, carboxymethylethylcellulose, dextrins and stark decomposed products.

Of these, specifically preferable compounds are block polymer (a Pluronic polymer) of polypropylene glycol and polyethylene glycol, polyethylene glycol (its average molecular weight is 2,000–20,000), methacrylic acid—methacrylic acid ester copolymers and methacrylic acid—acrylic acid ester copolymers whose typical one is Eudragid produced by Lame Firma Inc., dextrins and stark decomposed products whose typical ones are erysritol, maltose, mannitol, Pine Flow produced by Matsutani Chemical Co., Ltd. or Pinedex and methacrylic acid betaine polymer whose typical one is Yuka Former produced by Mitsubishi Yuka Co., Ltd.

These materials are preferably 0.5% or more and 20% or less against the weight of the solid processing agent, and specifically preferably 0.5% or more and 20% or less.

Next, when forming a tablet by compressing the resulting granule, conventional compressing machines, such as an oil-pressurers, a single pressure tableting machines, a rotary tableting machines and pricketing machines can be used. Preferably, it is preferable to separate each component such as an alkaline agent and a preserver and granulate them independently.

The tablet processing agents can be produced by conventional method as described in Japanese Patent O.P.I. Publication Nos. 61837/1976, 155038/1979 and 88025/1977 and British Patent No. 1,213,88. The granule processing agents can be produced by conventional methods described in Japanese Patent O.P.I. Publication Nos. 109042/1990, 109043/1990, 39735/1991 and 39739/1991. The powder processing agents can be produced by conventional methods described in Japanese Patent O.P.I. Publication No. 133332/1979, British Patent Nos. 725,892 and 729,862 and German Patent No. 3,733,861.

[Color developing process]

Time for the color developing step is defined to be time since a color developing solution is fed onto the leading edge of the light-sensitive material initially until a time when the processing solution of the next step is fed onto the leading edge of the light-sensitive material or until the leading edge of the light-sensitive material is immersed in the processing solution of the next step. The time for the color developing step is 5 seconds or more, and specifically 8 seconds or more from viewpoint of sufficiently and stably conducting the color developing step. In addition, 180 seconds or less and specifically 60 seconds or less is preferable since provision of adverse influence on the light-sensitive material due to deterioration or drying of the color developing solution fed onto the light-sensitive material can be prevented.

In the color developing step, plural processing solution feeding means may be provided so that the processing solution may be fed to the light-sensitive material from the first processing solution feeding means and then another processing solution may be fed from the second processing solution feeding means onto the light-sensitive material wherein the processing solution is fed from the first processing solution feeding means. In this occasion, the following three preferable embodiments are cited.

The first embodiment is that, when the light-sensitive material is subjected to color developing by a color developing agent which becomes active at pH of 7 or more, the first processing solution feeding means feeds the processing solution containing a color developing agent whose pH is 6 or less onto the light-sensitive material and the second processing solution feeding means feeds a color developing processing solution whose pH is 7 or more. Due to the above-mentioned structure, alkaline components whose diffusion speed are high are supplied and diffused after the color developing agent whose diffusion speed is slow is sufficiently diffused to the thickness direction of the light-sensitive material. Accordingly, problems such as uneven developing due to noticeable difference of developing starting time in the thickness direction of the light-sensitive layer can be prevented. When the light-sensitive material is a multi-layered color photographic light-sensitive material, coloring property of each primary colors becomes disrupted if the developing starting time is noticeably different in the thickness direction of each light-sensitive layer. Therefore, it is specifically useful. In the case of multi-layered light-sensitive materials having 5 or more layers and specifically 10 or more layers, such effect becomes extremely great.

The second embodiment is that the first processing solution feeding means feeds water to the light-sensitive material and that the second processing solution feeding means feeds the color developing processing solution to the light-sensitive material. Due to this structure, the color developing processing solution is fed after the light-sensitive material is provided with water and is sufficiently swollen. Therefore, components whose diffusion speed is slow in a hardened light-sensitive material are diffused at sufficiently high speed. As a result, problems such as uneven development due to noticeable difference of developing starting time in a thickness direction of a light-sensitive layer can be decreased.

The third embodiment is that the first processing solution feeding means feeds water containing an oxidant such as hydrogen peroxide onto the light-sensitive material and that the second processing solution feeding means feeds a color developing processing solution.

It is preferable that a silver halide emulsion of the present invention contains at least one or more emulsion layers containing silver halide grains wherein the content of silver chloride is 90 mol % or more. It is more preferable that the content of the silver chloride is 98–99.9 mol %, and it is further more preferable that the content of silver chloride is 98–99.9 mol %. It is specifically more preferable that all layers contain a silver bromochloride emulsion wherein the content of silver chloride is 98–99.9 mol %.

In the present invention, bleaching solutions, fixing solutions, bleach-fixing solutions and stabilizing solutions described in japanese Patent O.P.I. Publication No. 181837/1995 can be used.

DETAILED DESCRIPTION OF THE PREFERRED EMBODIMENT

Hereunder, examples of the present invention will be explained. The examples mentioned below shows practical examples of the present invention. However, the present invention is not limited thereto.

EXAMPLE 1

Figure 1:
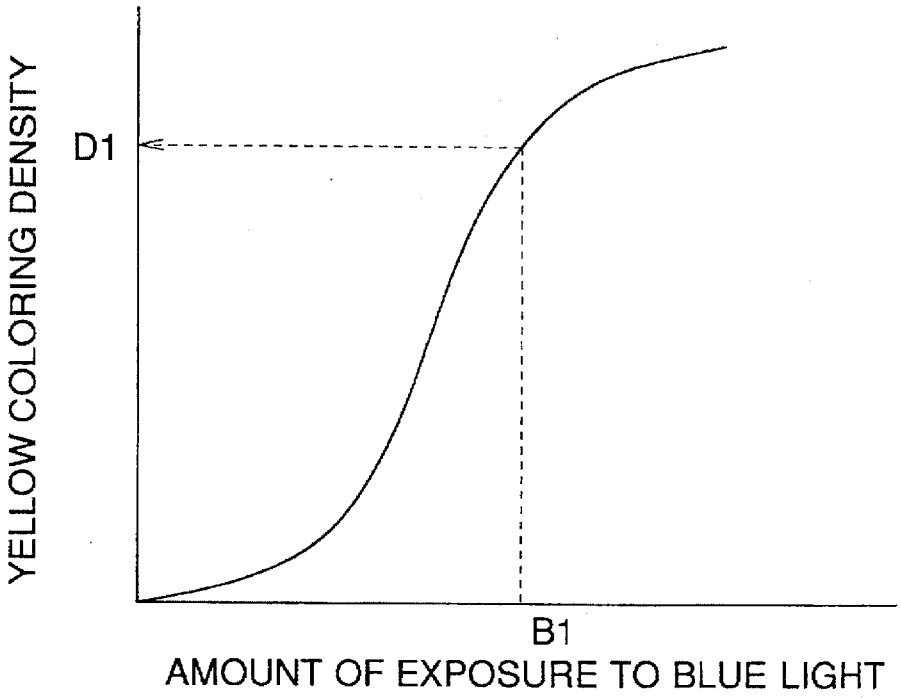
FIGS. 1(A) and 1(B) show a characteristic drawing of relationship between B exposure amount and Y coloring density, and also a characteristic drawing of relationship of Y dye produced amount corresponding to a Y coloring density D1.
Figure 1:
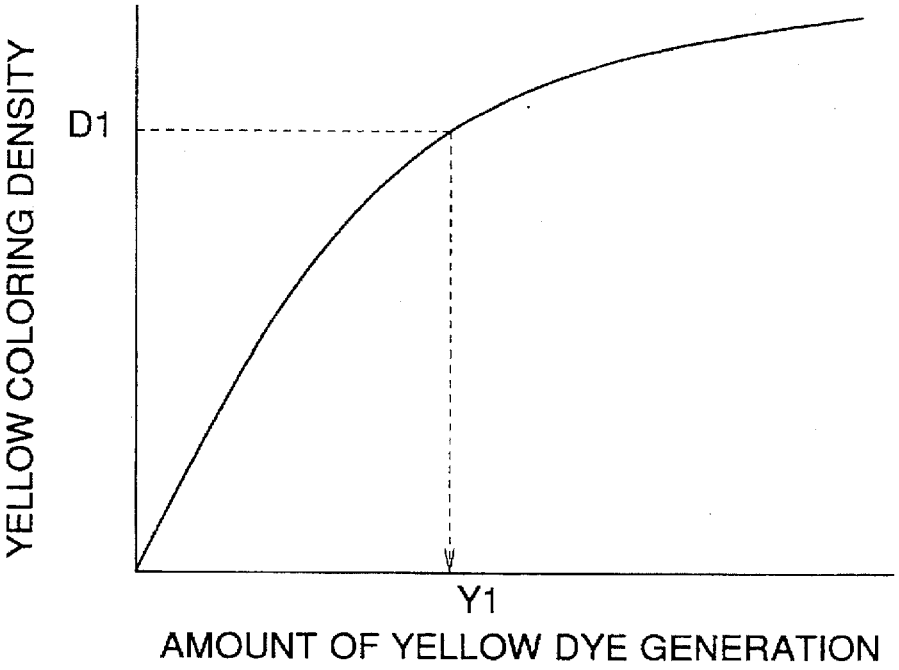

First, QA-A6 paper (a color photographic paper) p produced by Konica Corporation was subjected to separation wedge exposure to B, G and R light. By the use of chemical process CPK-2-20 produced by Konica, the above-mentioned paper was processed. From these results, the relationships between B, G and R exposure amount and Y, M and C coloring density respectively (characteristics curves) were measured. Namely, due to a characteristics drawing shown in FIG. 1(A), yellow coloring density D1 corresponding to blue exposure amount B1 can be measured. Next, B, G and R exposure amount which was equivalent to each of Y, M and C separation wedge steps was provided to the above-mentioned 100 $cm^2$ QA-A6 paper. Following this, Y, M and C dyes in the processed samples were taken up and they were subjected to quantitative analysis. From these results, relationships between Y, M and C coloring densities and Y, M and C dyes produced amount can be calculated. Namely, in a characteristics curve shown in FIG. 1(B), the relationship of Y dye producing amount corresponding to Y coloring density D1 (a function of Y1=F(B1)) is calculated. Next, the amount of color developing agent (CD-3) necessary to produce the amount of Y, M and C dyes for each wedge step were measured by means of development experiments. From this result, when Y, M and C coloring densities are $D_Y$, $D_M$ and $D_C$, conversion functions f, g and h which result in the amounts of coloring developing agents (CD-3) $V_Y$, $V_M$ and $V_C$ necessary to produce aforesaid coloring density were measured:

$V_Y=f(D_Y)$ $V_M=g(D_m)$ $V_C=h(D_C)$

Figure 2:
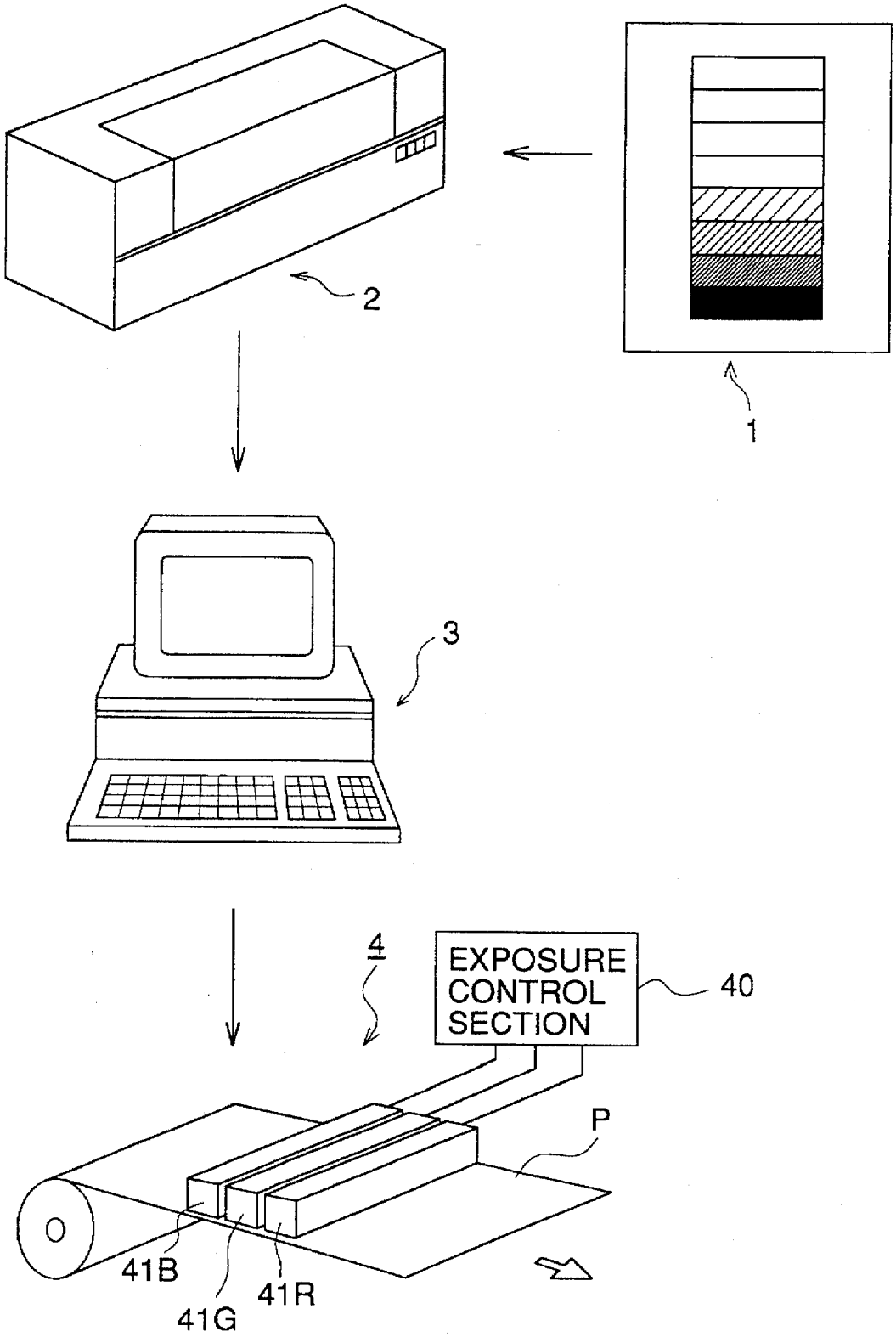
FIG. 2 shows a process drawing of a step since a sample subjected to gray wedge developing is read until exposure is given to a color photographic paper.

Next, FIG. 2 shows a step since a sample image subjected to ordinary gray wedge development wherein the above-mentioned color photographic paper p was processed with CPK-2-20 was read until aforesaid color photographic paper p was subjected to exposure to light. First, image information (integral density) of the above-mentioned wedge-developed sample 1 was read by photo-scanner 2 (for example, Drum Scanning Densitometer Model 2605 produced by Abe Sekkei Co., Ltd.) was read. This image signal (integral density) was converted to analysis density by means of image processing device 3. Following this, this analysis density was further converted to the amount of exposure onto the above-mentioned color photographic paper p from silver halide photographic sensitive material light-exposure device (hereinafter, referred to as "light-exposure device") by means of image processing device 3. From the above-mentioned exposure device 4, aforesaid color photographic paper p was subjected to exposure to light.

When a photographic paper for color photography which is a color silver halide light-sensitive material (hereinafter, simply referred to as "photographic paper") is conveyed in the arrowed direction, red light source printing head $41_R$ having an LED array, green light source printing head $41_G$ having a vacuum fluorescent tube array and blue light source printing head $41_B$ are controlled to be exposed to light by light-exposure control unit 40 in accordance with image data so that a prescribed portions of photographic paper P are exposed to light for each color.

Figure 3:
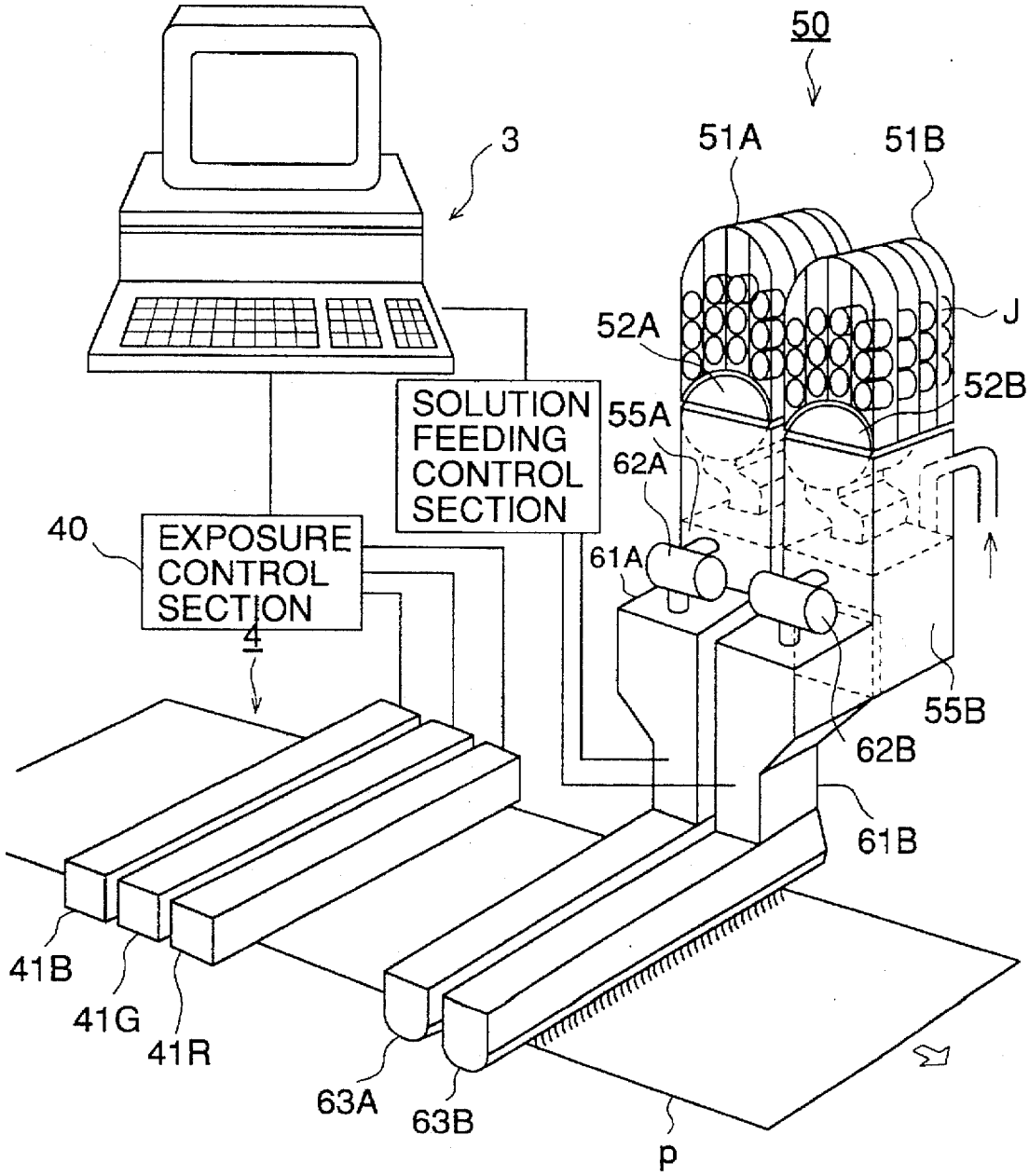
FIG. 3 shows a perspective view of a process in which a photographic paper is subjected to exposure and color developing.
Figure 4:
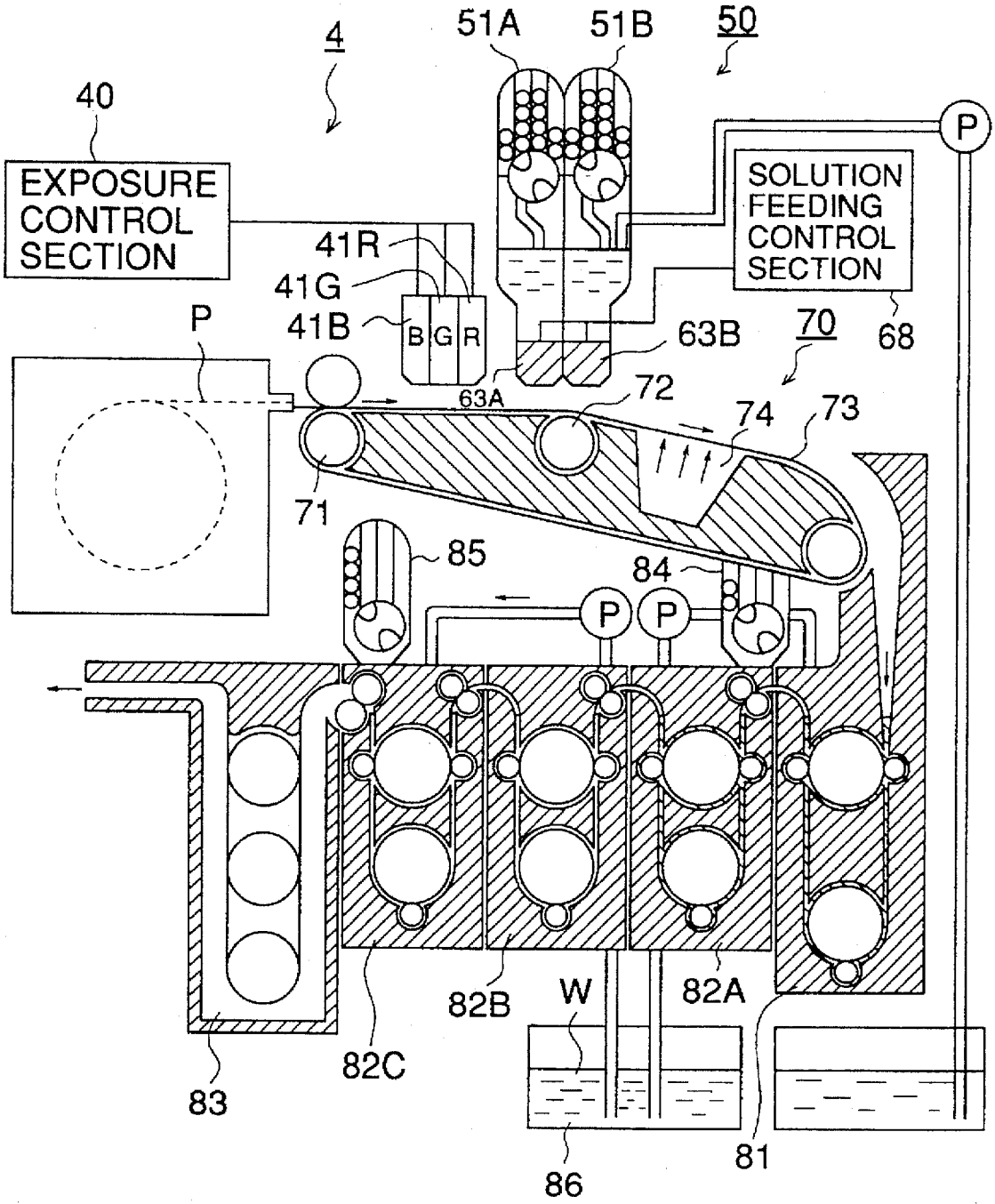
FIG. 4 shows a block diagram of a process since exposure to light until all of developing to drying steps.

Next, FIGS. 3 and 4 show a processor which processes photographic paper p which had been exposed to light by a method of the present invention. FIG. 3 is a perspective view showing a process in which the above-mentioned photographic paper p is subjected to light exposure and color developing. FIG. 4 is a block diagram showing a process from light exposure to all developing processes and drying.

Downstream of the conveyance path of the photographic paper from the above-mentioned exposure device 4, color developing device 50 is provided which faces the emulsion surface of the photographic paper. Aforesaid color developing device 50 will be explained later. Below the above-mentioned light exposure device 47 and color developing device 50, photographic paper conveyance means 70 composed of conveyance roller 71, platen roller 72, conveyance belt 73 and heating unit 74 is provided. In addition, downstream of the conveyance path, a processing solution tank composed of bleach-fixing tank 81, first stabilizing tank 82A, second stabilizing tank 82B and the third stabilizing tank 82C and drying unit 83 are located. Numeral 84 is a replenishing device which replenishes a solid processing agent for bleach-fixing to the above-mentioned bleach-fixing tank 81, and numeral 85 is a replenishing device which replenishes a solid processing agent for stabilizing to the above-mentioned third stabilizing tank 82C. Numeral 86 is a replenishing water feeding container which feeds replenishing water W to the above-mentioned bleach-fixing tank 81 and third stabilizing tank 82C.

First, the above-mentioned image processing device 3 outputs a signal which converts the amount of light exposure onto the above-mentioned photographic paper p to the feeding amount of color developing solution. In accordance with this signal, color developing is conducted in developing device 5. Thus, printing is completed.

Figure 5:
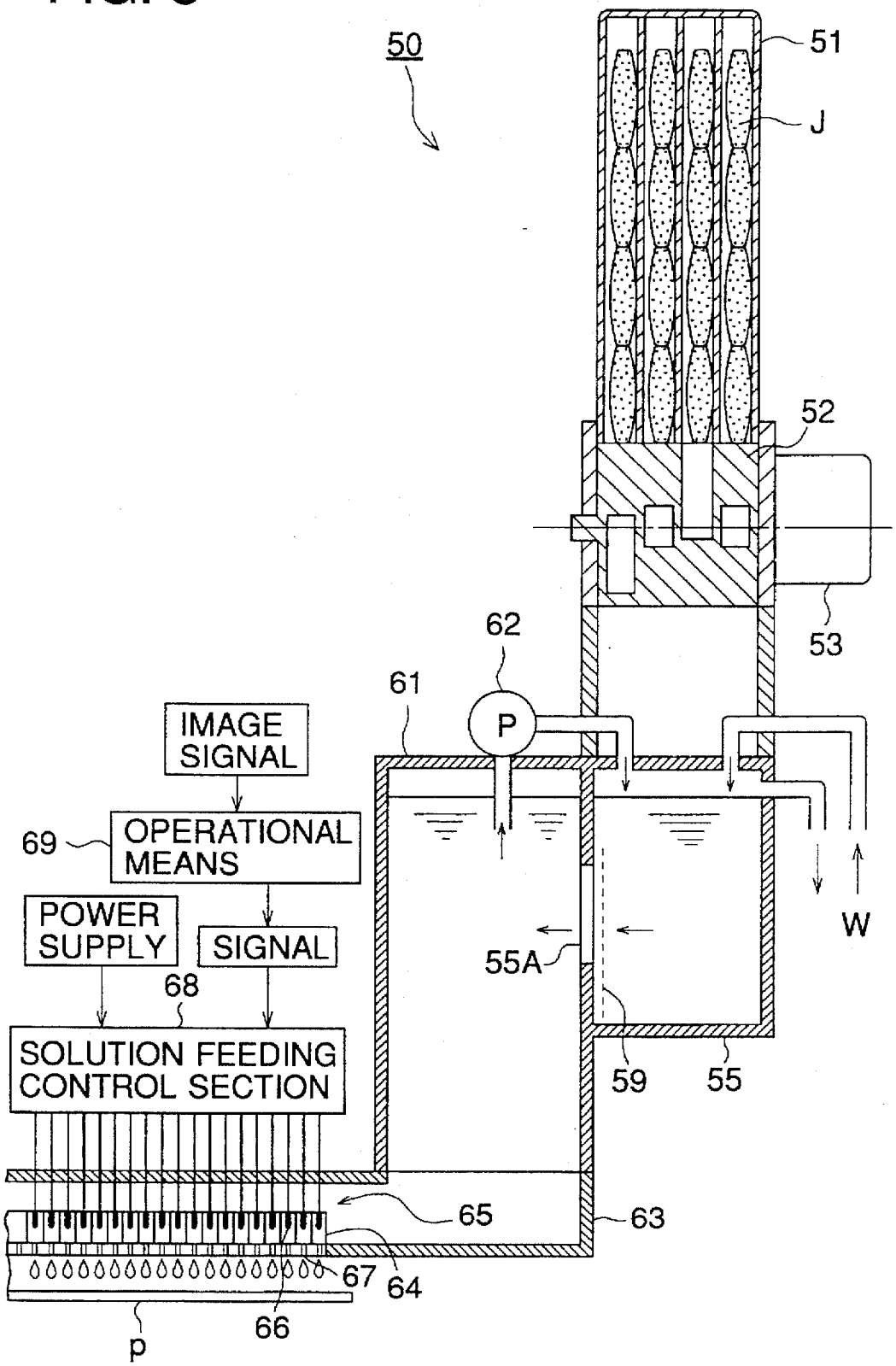
FIG. 5 shows a side cross-sectional view of a solid processing agent replenishing device and a color developing device.
Figure 6:
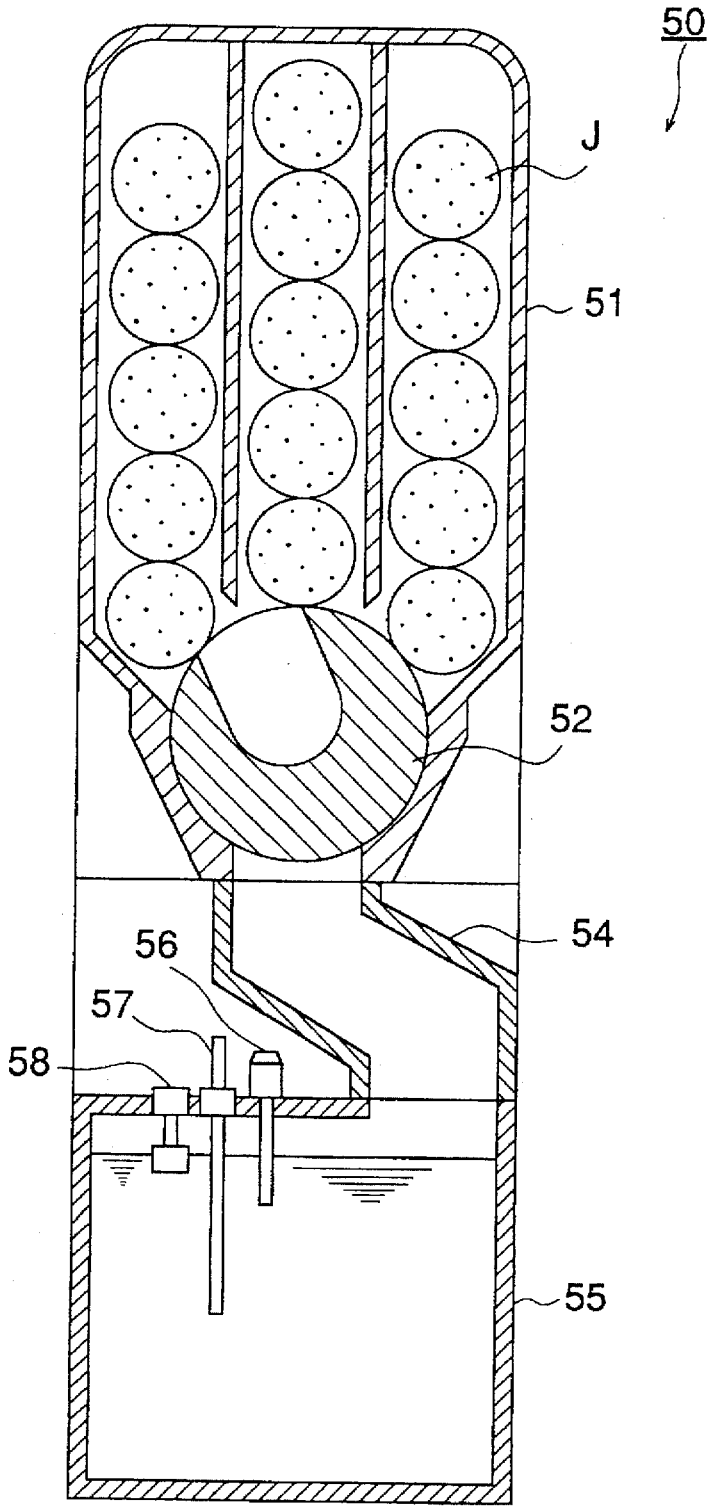
FIG. 6 shows a front cross-sectional view of a dissolution tank of the color developing device and the solid processing agent replenishing device.

FIG. 5 is a side cross sectional view of solid processing agent replenishing device 50 and color developing processing device 60. FIG. 6 is a front cross-sectional view of a dissolution tank in aforesaid color developing processing device 60 and solid processing agent replenishing device 50.

As a solid processing agent for replenishing, a tablet type, a granule type, a powder type and a small particle type are used. Specifically, the tablet type is preferable. In the present example, a case where tablet-type solid processing agent J is used as a solid processing agent will be explained. However, the present invention is applicable also to granule type solid processing agent too.

Solid processing agent replenishing device 50 is composed of housing container which houses plural tablet type solid processing agent J, supplying means 52 which receives aforesaid solid processing agent J, rotates and drops aforesaid solid processing agent intermittently one by one, driving means 53 which drives aforesaid supplying means, control means (not illustrated) which controls aforesaid driving means 53 and supplies an appropriate amount of solid processing agent J to the dissolution tank described later and a guide member which introduces solid processing agent J dropped from the above-mentioned supplying means to in the vicinity of the processing solution surface of the above-mentioned replenishing tank 55.

Inside the above-mentioned dissolution tank 55, temperature sensor 56, heater 57 and liquid surface sensor 58 are provided. On one of side wall of aforesaid solution tank 55, processing solution communication opening 55A is penetrated. The processing solution inside dissolution tank 55 is communicated to adjoining developing solution tank 61 (processing solution container) through filter 59. The processing solution inside aforesaid developing solution tank 61 is circulated to the above-mentioned dissolution tank 55 by means of circulation pump 62.

As shown in FIG. 5, at the lower portion of the above-mentioned developing solution tank 61, processing solution feeding means 63 is fixed. Inside this processing solution feeding means 63 is composed of plural processing solution stations 64 and common processing solution path 65 which feeds the processing solution in the above-mentioned developing processing solution 61 by communicating with aforesaid plural processing solution stations 64. On each of plural processing solution stations 64, solution drop generation means 66 is respectively provided. Aforesaid solution drop generation means 66 may either be (1) one which sprays solution drops from orifices 67 by changing volume inside processing solution station (pressure station) 64 due to an electric-mechanical conversion means such as Piezo electric element, or (2) one which causes orifices 67 solution drop from orifices 67 by enhancing processing solution pressure due to generating and swelling bubbles inside the processing solution station (pressure station by means of a heating element. These technologies are put into practical use in ink jet printers. Solution drops which are sprayed from orifices 67 and fly through the air are adhered on the emulsion surface of photographic paper p so that latent images formed by the above-mentioned light exposure means 4 are subjected to color developing to form visual images.

The above-mentioned solution drop generation means 66 is connected to solution feeding control unit 68, and, due to a signal from operation means 69 which operates image signals, it generates drop of solution and cause splashing only necessary solution drop with necessary timing (on demand).

In FIGS. 3 and 4, numeral 51A is a solid processing agent housing container for the first color developing, numeral 52A is supplying means for the first color developing, numeral 55A is a dissolution tank for the first color developing, numeral 61A is a processing solution container for the first color developing, numeral 62A is a circulation pump for the first color developing and numeral 63A is a processing solution feeding means for the first color developing. In the same manner, numeral 51B is a solid processing agent housing container for the second color developing, numeral 52B is a supplying means for the second color developing, numeral 55B is a dissolution tank for the second color developing, numeral 61B is a processing solution container for the second color developing, numeral 62B is a circulation pump for the second color developing and numeral 63B is a processing solution feeding means for the second color developing.

Figure 7:
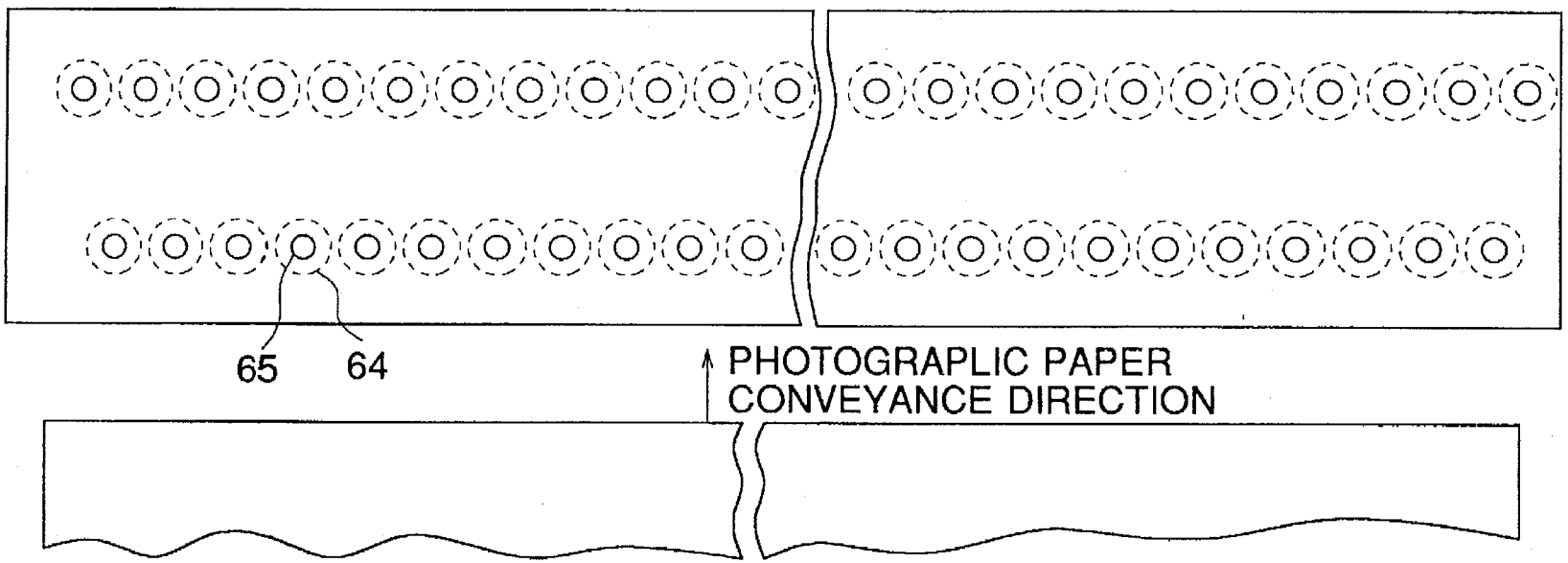
FIG. 7 shows an enlarged drawing of an orifice front view in the processing solution station.

FIG. 7 is an extended drawing of the front view of the orifice of the above-mentioned processing solution stations 64. Plural orifices 67 are provided in a form of two rows. By shifting the first orifice row and the second orifice row by a half pitch, the solution drop density of the lateral direction perpendicular to the conveyance direction of photographic paper is enhanced. The density of plural orifices 67 in the lateral direction is determined by the color developing density to be needed. In addition, plural orifices are not limited to two rows. It may be one row or three or more rows. The above-mentioned solution drop generation means 66 is provided on a side surface of processing solution stations 64 which communicates orifices 67 or on a plane facing orifices 67.

Figure 8:
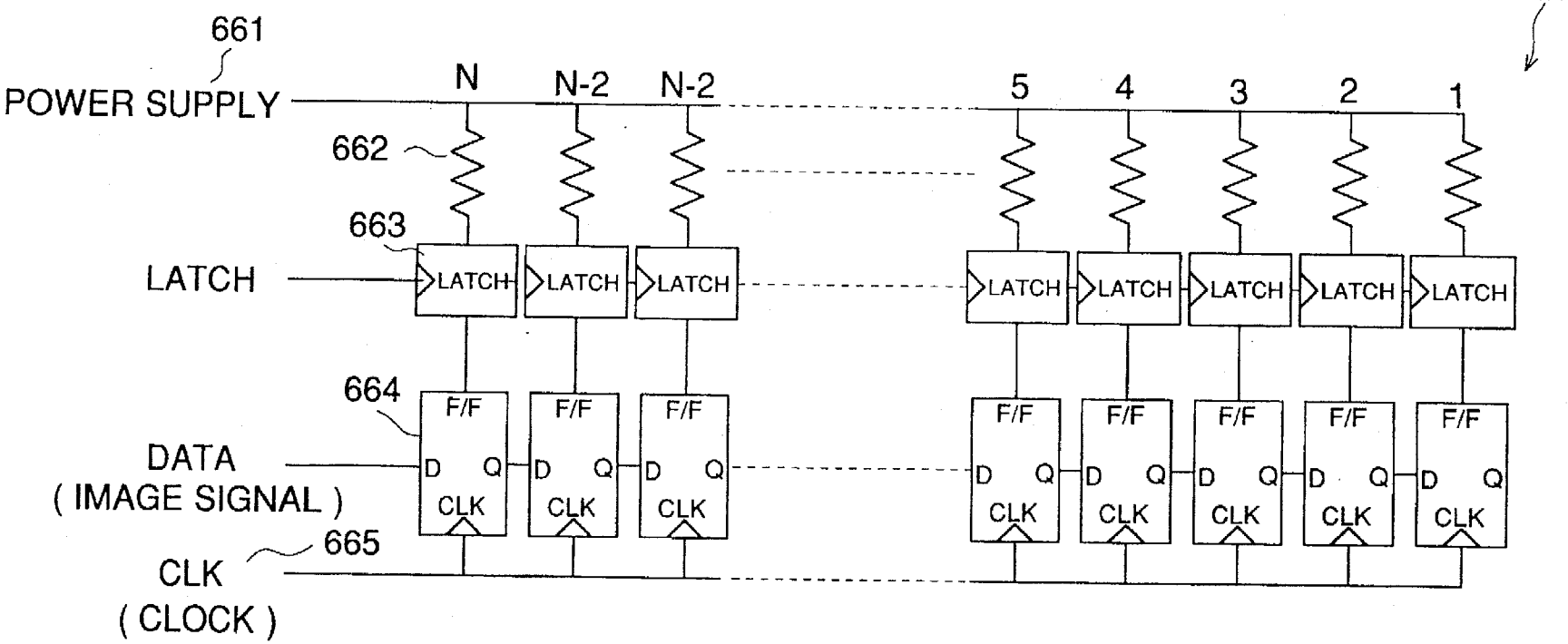
FIG. 8 shows a circuit drawing of a solution drop generation means.

FIG. 8 is a circulation drawing of solution drop generation means 66. In FIG. 8, numeral 661 represents a power supply, numeral 662 is a heating element which generates and swell the above-mentioned bubble. Numeral 663 represents a latch. Numeral 664 is a flip-flop which amplifies image signals. Numeral 665 represents a clock which generates a standard pulse.

Supply amount of the color developing agent was adjusted by adjusting the number of spraying dots in a unit area, in the same manner as in an ordinary ink jet printer.

Next, the processing solution feeding head will be explained. For this, a bubble jet type bar-shaped feeding head will be used. This bar-shaped feeding head is perpendicular to the conveyance direction of the light-sensitive material. The conveyance speed of the light-sensitive material was set to be 30 mm/sec. As shown in FIG. 5, the arrangement of the feeding port is a two-row zigzag arrangement. The interval of the feeding port is 100 μm in terms of the distance of the fringes of two adjacent feeding ports. The diameter of the feeding port is 50 μm, and the number of feeding the processing solution per second is 3,000 times.

Next, a processing agent for silver halide photographic light-sensitive material used in the present example and the processing steps the same will be explained.

<Processing agent for Color developing>

Tablet-type processing agent for the first color developing

In a commercially available bandam mill, 400 g of a color developing agent VD-3, i.e., 4-amino-3-methyl-N-ethyl-N-(B-(methanesulfonamide)ethyl)aniline sulfate were crushed until their average particle size became 10 μm. To this fine particle, 100 g of polyethyleneglycol whose average molecular weight by weight was 4,000 was add, and then, mixed uniformly in a commercial mixer. Next, the resulting mixture was granuled in a commercially available granulator for 7 minutes at station temperature by adding it 15 ml of water. Following this, the granuled product was dried in a fluid bed layer drier at 40° C. for 2 hours so that moisture in the granulated product was removed almost completely. The resulting granulated product was subjected to continuous compression tableting in a rotary tableting machine (Clean Press Correct H18, produced by Kikusui Seisakusho) wherein the diameter was 20 mm, thickness was 7 mm, a filling amount per tablet was 3 g and tableting pressure was 4 t) so that a processing agent for the first color developing solution replenishing was prepared.

Tablet type processing agent for the second color developing

In a commercially available bandam mill, 40 g of pentasodium diethylenetriamine pendaacetic acid and 1200 g of sodium carbonate anhydride were crushed until their average particle size becomes 10 μm. To this fine particle, 100 g of polyethylene glycol whose average molecular weight by weight was 4000 added, and then, this mixture was uniformly mixed. Next, the resulting mixture was granuled in a commercially available stirring granulating machine for 7 minutes at station temperature by adding water of 30 ml. Following this, this granulated product was dried in a fluid bed layer drier at 40° C. for 2 hours so that moisture in the granulated product was removed almost completely. The resulting granulated product was mixed using a commercially available cross-rotary mixer at station temperature for 10 minutes. To the resulting mixture, 5 g of sodium N-myrystoil-alanine was added for additional mixing for 3 minutes. This mixture was subjected to continuous compression tableting wherein the diameter was 20 mm, thickness was 7 mm, a filling amount per tablet was 3 g and tableting pressure was 4 t so that a tablet-type processing agent for the second color developing solution replenishing was prepared.

Processing solution for the first color developing

In 1 liter of water, 25 tablets of the above-mentioned tablet-type processing solution for the first color developing was dissolved so that a processing solution for the first color developing was prepared.

Processing solution for the first color developing

In 1 liter of water, 60 tablets of the above-mentioned tablet-type processing solution for the second color developing was dissolved so that a processing solution for the second color developing was prepared.

<Processing agent for bleach-fixing>

Processing agents for CPK-2-J1 processing were used for a tablet-type processing agent for bleach-fixing and a processing solution for bleach-fixing were respectively used.

<Processing agent for bleach-fixing>

Processing agents for CPK-2-J1 processing were used for a tablet-type processing agent for stabilizing and a processing solution for stabilizing were respectively used.

<Processing steps>

Table 1 shows processing steps.

TABLE 1

| Step | Processing time | Amount of replenishing water | Amount of tablet supplied |
|---|---|---|---|
| Color developing | 10 seconds | (First) 39 ml/J | 3.7 $m^2$/J |
| | | (Second) 16 ml/J | 1.3 $m^2$/J |
| Bleach-fixing | 20 seconds | 39 ml/J | 0.81 $m^2$/J |
| Stabilizing | 20 seconds × 3 | 1166 ml/J | 9.72 $m^2$/J |
| Drying | 25 seconds | — | — |

As a replenishing water for the bleach-fixing tank, a stabilizing processing solution for the stabilizing first tank was used. In addition, with regard to the stable tank, a three-tank cascade system was adopted.

Using the above-mentioned system, a running experiment in a processing amount of 0.1 $m^2$ per day was conducted for 10 days.

(Results)

It was confirmed that, owing to the above-mentioned system of the present invention, the amount of used color developing agent could be further reduced and that stable processing performance could be maintained without occurring stain under running status wherein the processing amount was extremely small as described above.

By setting conversion functions f, g and h which convert the coloring density to the amount of supplying color developing agent $$f(D1)>g(D1)$$

and concurrently $$f(D1)>h(D1)$$

coloring reaction of Y, M and C dyes can be advanced with well balance so that further rapid and stable processing performance can be provided.

EXAMPLE 2

Example 2 was conducted in the same manner as in Example 1, except that conversion functions f', g' and h' which respectively convert integral density inpY, InpM and InpC read by reflective original reading device 2 to the amount of supplying color developing agents $V_Y$, $V_M$ and $V_C$ directly were set, the following conversions were conducted when reading aforesaid reflective original $V_Y$=F' (InpY)

$V_M$=G' (InpM)

$V_C$=H' (InpC)

and the amount of supplying the color developing agent in accordance with each image signal was determined. As a result, the following issues were confirmed: the amount of color developing agent used in the same manner as in Example 1 could be further reduced. In addition, under running status wherein the amount of processing is extremely small, stable processing performance could be maintained without occurring stain.

Incidentally, in Examples 1 and 2, a conversion table is prepared from the calculation result by the calculating means, and the conversion table can be stored in a form of a look-up table in a memory. By inputting an image signal representing a density level or an exposure signal representing a light amount into the look-up table, a processing signal representing a necessary amount of a color developing agent can be outputted from the look-up table without a calculation.

The present invention forms images by feeding necessary color developing solution on-demand as processing solution drops against latent images formed on a color photographic paper, and it provides an automatic processing machine maintaining stable processing performance even when the amount of processing is extremely small and capable of reducing to a minimum the consumption of processing agent component used for aforesaid automatic processing machine.

What is claimed is:

1. An apparatus for processing a silver halide photographic material having an emulsion surface, wherein an exposure signal representing a light amount is determined from an image signal representing a density level of an image and a portion of the emulsion surface is exposed to a light on the basis of the exposure signal, the apparatus comprising;

a container in which a processing solution to process the silver halide photographic material is stored;

supplying means located so as to be spaced from the emulsion surface of the silver halide photographic material and supplying the processing solution from the container to the emulsion surface through a space;

converting means for converting one of the density level of the image signal and the light amount of the exposure signal into a processing signal representing an amount of the processing solution; and regulating means for regulating an amount of the processing solution for each portion of the emulsion surface in accordance with the processing signal so that the regulated amount of the processing solution is different from portion to portion on the emulsion surface depending on an exposed light amount of each portion.

2. The apparatus of claim 1, wherein the processing solution is at least one of a color developing solution and a bleaching solution.

3. The apparatus of claim 1, wherein the processing solution is a color developing solution containing a color developing agent.

4. The apparatus of claim 3, wherein the converting means comprises a first calculating means for converting one of the density level of the image signal and the light amount of the exposure signal into a coloring density on the silver halide photographic material and a second calculating means for converting the coloring density to an amount of the color developing agent necessary to obtain the coloring density.

5. The apparatus of claim 4, wherein the image is split into three color component image signals and the silver halide photographic material comprises a yellow coloring material, a magenta coloring material and a cyan coloring material.

6. The apparatus of claim 5, wherein the first calculating means converts the three color component image signals into a coloring density $D_Y$ of the yellow coloring material, a coloring density $D_M$ of the magenta coloring material and a coloring density $D_C$ of the cyan coloring material, and the second calculating means has a function $f(D_Y)$ to convert the coloring density $D_Y$ into an amount of the color developing agent, a function $g(D_M)$ to convert the coloring density $D_M$ into an amount of the color developing agent and a function $h(D_C)$ to convert the coloring density $D_C$ into an amount of the color developing agent, and wherein an amount V of the color developing agent to be supplied to the emulsion surface of the silver halide photographic material is obtained by the following formula:

$$V=f(D_Y)+g(D_M)+h(D_C).$$

7. The apparatus of claim 6, wherein the functions are prepared to satisfy the following relations for the same coloring density D1:

$$f(D1)>g(D1) \text{ and } f(D1)>h(D1).$$

8. The apparatus of claim 1, wherein the density level is an analytical density.

9. The apparatus of claim 1, further comprising exposing means for exposing the emulsion surface of the silver halide photographic material to the light.

10. The apparatus of claim 9, further comprising conveying means for conveying the exposed silver halide photographic material to the supplying means.

11. The apparatus of claim 10, wherein the supplying means comprises a line-shaped supply head arranged perpendicularly to the conveying direction.

12. The apparatus of claim 11, wherein the line-shaped supply head comprises plural supply elements aligned in two lines in which the plural supply elements on the two lines are staggered.

13. The apparatus of claim 11, wherein the supplying means comprises a first line-shaped supply head and a second line-shaped supply head placed downstream of the first line-shaped supply head in relation to the conveying direction.

14. The apparatus of claim 13, wherein the first line-shaped supply head supplies a first solution which contains a color developing agent and has a PH value lower than 7, and the second line-shaped supply head supplies a second solution having a PH value higher than 7.

15. The apparatus of claim 13, wherein the first line-shaped supply head supplies water, and the second line-shaped supply head supplies a color developing solution.

16. The apparatus of claim 13, wherein the first line-shaped supply head supplies water containing an oxidant, and the second line-shaped supply head supplies a color developing solution.

17. The apparatus of claim 1, wherein the supplying means is solution drop jetting means for jetting the processing solution in a form of droplet.

18. The apparatus of claim 1, further comprising solid processing agent-replenishing means for supplying a solid processing agent to the container and water-replenishing means for supplying water to the container.

19. An apparatus for processing a silver halide photographic material having an emulsion surface, wherein an exposure signal representing a light amount is determined from an image signal representing a density level of an image and the emulsion surface is exposed to a light on the basis of the exposure signal, the apparatus comprising;

a container in which a processing solution to process the silver halide photographic material is stored;

supplying means located so as to be spaced from the emulsion surface of the silver halide photographic material and supplying the processing solution from the container to the emulsion surface through a space;

converting means for converting one of the density level of the image signal and the light amount of the exposure signal into a processing signal representing an amount of the processing solution; and regulating means for regulating an amount of the processing solution in accordance with the processing signal so that the regulated amount of the processing solution is supplied to the emulsion surface of the silver halide photographic material through the space by the supplying means;

wherein the processing solution is a color developing solution containing a color developing agent, wherein the converting means comprises a first calculating means for converting one of the density level of the image signal and the light amount of the exposure signal into a coloring density on the silver halide photographic material and a second calculating means for converting the coloring density to an amount of the color developing agent necessary to obtain the coloring density, wherein the image is split into three color component image signals and the silver halide photographic material comprises a yellow coloring material, a magenta coloring material and a cyan coloring material, wherein the first calculating means converts the three color component image signals into a coloring density $D_Y$ of the yellow coloring material, a coloring density $D_M$ of the magenta coloring material and a coloring density $D_C$ of the cyan coloring material, and the second calculating means has a function $f(D_Y)$ to convert the coloring density $D_Y$ into an amount of the color developing agent, a function $g(D_M)$ to convert the coloring density $D_M$ into an amount of the color developing agent and a function $h(D_C)$ to convert the coloring density $D_C$ into an amount of the color developing agent, and wherein an amount V of the color developing agent to be supplied to the emulsion surface of the silver halide photographic material is obtained by the following formula:

$$V=f(D_Y)+g(D_M)+h(D_C)$$

and wherein the functions are prepared to satisfy the following relations for the same coloring density D1:

$$f(D1)>g(D1) \text{ and } f(D1)>h(D1).$$

20. An apparatus for processing a silver halide photographic material having an emulsion surface, wherein an exposure signal representing a light amount is determined from an image signal representing a density level of an image and the emulsion surface is exposed to a light on the basis of the exposure signal, the apparatus comprising;

a container in which a processing solution to process the silver halide photographic material is stored;

supplying means located so as to be spaced from the emulsion surface of the silver halide photographic material and supplying the processing solution from the container to the emulsion surface through a space;

converting means for converting one of the density level of the image signal and the light amount of the exposure signal into a processing signal representing an amount of the processing solution;

regulating means for regulating an amount of the processing solution in accordance with the processing signal so that the regulated amount of the processing solution is supplied to the emulsion surface of the silver halide photographic material through the space by the supplying means;

exposing means for exposing the emulsion surface of the silver halide photographic material to the light; and conveying means for conveying the exposed silver halide photographic material to the supplying means, wherein the supplying means comprises a line-shaped supply head arranged perpendicularly to the conveying direction, wherein the line-shaped supply head comprises a first line-shaped supply head and a second line-shaped supply head placed downstream of the first line-shaped supply head in relation to the conveying direction, and wherein the first line-shaped supply head supplies a first solution which contains a color developing agent and has a PH value lower than 7, and the second line-shaped supply head supplies a second solution having a PH value higher than 7.

21. An apparatus for processing a silver halide photographic material having an emulsion surface, wherein an exposure signal representing a light amount is determined from an image signal representing a density level of an image and the emulsion surface is exposed to a light on the basis of the exposure signal, the apparatus comprising;

a container in which a processing solution to process the silver halide photographic material is stored;

supplying means located so as to be spaced from the emulsion surface of the silver halide photographic material and supplying the processing solution from the container to the emulsion surface through a space;

converting means for converting one of the density level of the image signal and the light amount of the exposure signal into a processing signal representing an amount of the processing solution;

regulating means for regulating an amount of the processing solution in accordance with the processing signal so that the regulated amount of the processing solution is supplied to the emulsion surface of the silver halide photographic material through the space by the supplying means;

exposing means for exposing the emulsion surface of the silver halide photographic material to the light; and conveying means for conveying the exposed silver halide photographic material to the supplying means, wherein the supplying means comprises a line-shaped supply head arranged perpendicularly to the conveying direction, wherein the line-shaped supply head comprises a first line-shaped supply head and a second line-shaped supply head placed downstream of the first line-shaped supply head in relation to the conveying direction, and wherein the first line-shaped supply head supplies water containing an oxidant, and the second line-shaped supply head supplies a color developing solution.

* * * * *